US005778469A

United States Patent [19]

Festa

[11] Patent Number: 5,778,469

[45] Date of Patent: Jul. 14, 1998

[54] THERAPEUTIC CERVICAL PILLOW

[76] Inventor: John Philip Festa, 752 County Ave Apt C15, Secaucus, N.J. 07094

[21] Appl. No.: 855,195

[22] Filed: May 13, 1997

[51] Int. Cl.[6] ..... A47G 9/00

[52] U.S. Cl. ..... 5/640; 5/636; 5/643; 297/393; 297/408

[58] Field of Search ..... 5/636, 637, 640, 5/643; 297/393, 397, 408

[56] References Cited

U.S. PATENT DOCUMENTS

| | | | |
|---|---|---|---|
| 1,510,187 | 9/1924 | Martin | 297/393 |
| 2,336,707 | 12/1943 | Thompson | 5/636 |
| 4,285,081 | 8/1981 | Price | 5/637 |
| 5,129,705 | 7/1992 | Wray | 5/636 |
| 5,257,429 | 11/1993 | Genis | 5/640 |
| 5,544,378 | 8/1996 | Chow | 5/640 |
| 5,546,619 | 8/1996 | Braun | 5/640 |

FOREIGN PATENT DOCUMENTS

| | | | |
|---|---|---|---|
| 838455 | 6/1960 | United Kingdom | 297/393 |
| 2198341 | 6/1988 | United Kingdom . | |

*Primary Examiner*—Alexander Grosz

[57] ABSTRACT

A new therapeutic cervical pillow for aiding individuals with cervical spine aliments. The inventive device includes a concave pillow member having a back portion having an arcuate surface, and a pair laterally opposing arcuate side portions extending from the back portion. The arcuate side portions and said back portion arcuate surface define a concavity for accepting the neck of a person for supporting the cervical spine when in a seated position. A pivot pin is employed to permit pivoting of each of the side portions of the pillow relative to the back portion and the other side portion of the pillow.

8 Claims, 2 Drawing Sheets

THERAPEUTIC CERVICAL PILLOW

BACKGROUND OF THE INVENTION

1. Field of the Invention

The present invention relates to therapeutic devices and more particularly pertains to a new therapeutic cervical pillow for aiding individuals with cervical spine aliments.

2. Description of the Prior Art

The use of therapeutic devices is known in the prior art. More specifically, therapeutic devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art therapeutic devices include U.S. Pat. No. 5,129,705; U.S. Pat. No. 4,838,611; U.S. Pat. No. Des. 322,380; U.S. Pat. No. 5,257,429; U.S. Pat. No. Des. 328, 682; and U.S. Pat. No. 4,832,007.

While these devices fulfill their respective, particular objectives and requirements, the aforementioned patents do not disclose a new therapeutic cervical pillow. The inventive device includes a concave pillow member having a back portion having an arcuate surface, and a pair laterally opposing arcuate side portions extending from the back portion. The arcuate side portions and said back portion arcuate surface define a concavity for accepting the neck of a person for supporting the cervical spine when in a seated position.

In these respects, the therapeutic cervical pillow according to the present invention substantially departs from the conventional concepts and designs of the prior art, and in so doing provides an apparatus primarily developed for the purpose of aiding individuals with cervical spine aliments.

SUMMARY OF THE INVENTION

In view of the foregoing disadvantages inherent in the known types of therapeutic devices now present in the prior art, the present invention provides a new therapeutic cervical pillow construction wherein the same can be utilized for aiding individuals with cervical spine aliments.

The general purpose of the present invention, which will be described subsequently in greater detail, is to provide a new therapeutic cervical pillow apparatus and method which has many of the advantages of the therapeutic devices mentioned heretofore and many novel features that result in a new therapeutic cervical pillow which is not anticipated, rendered obvious, suggested, or even implied by any of the prior art therapeutic devices, either alone or in any combination thereof.

To attain this, the present invention generally comprises a concave pillow member having a back portion having an arcuate surface, and a pair laterally opposing arcuate side portions extending from the back portion. The arcuate side portions and said back portion arcuate surface define a concavity for accepting the neck of a person for supporting the cervical spine when in a seated position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new therapeutic cervical pillow apparatus and method which has many of the advantages of the therapeutic devices mentioned heretofore and many novel features that result in a new therapeutic cervical pillow which is not anticipated, rendered obvious, suggested, or even implied by any of the prior art therapeutic devices, either alone or in any combination thereof.

It is another object of the present invention to provide a new therapeutic cervical pillow which may be easily and efficiently manufactured and marketed.

It is a further object of the present invention to provide a new therapeutic cervical pillow which is of a durable and reliable construction.

An even further object of the present invention is to provide a new therapeutic cervical pillow which is susceptible of a low cost of manufacture with regard to both materials and labor, and which accordingly is then susceptible of low prices of sale to the consuming public, thereby making such therapeutic cervical pillow economically available to the buying public.

Still yet another object of the present invention is to provide a new therapeutic cervical pillow which provides in the apparatuses and methods of the prior art some of the advantages thereof, while simultaneously overcoming some of the disadvantages normally associated therewith.

Still another object of the present invention is to provide a new therapeutic cervical pillow for aiding individuals with cervical spine aliments.

Yet another object of the present invention is to provide a new therapeutic cervical pillow which includes a concave pillow member having a back portion having an arcuate surface, and a pair laterally opposing arcuate side portions extending from the back portion. The arcuate side portions and said back portion arcuate surface define a concavity for accepting the neck of a person for supporting the cervical spine when in a seated position.

Still yet another object of the present invention is to provide a new therapeutic cervical pillow that may be fitted over the top of the head rest of a car seat to support the submandibular, occipital, and mastoid areas of the head when sleeping in a seat.

Even still another object of the present invention is to provide a new therapeutic cervical pillow that helps maintain the proper alignment of the cervical spine when sitting for long periods of time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
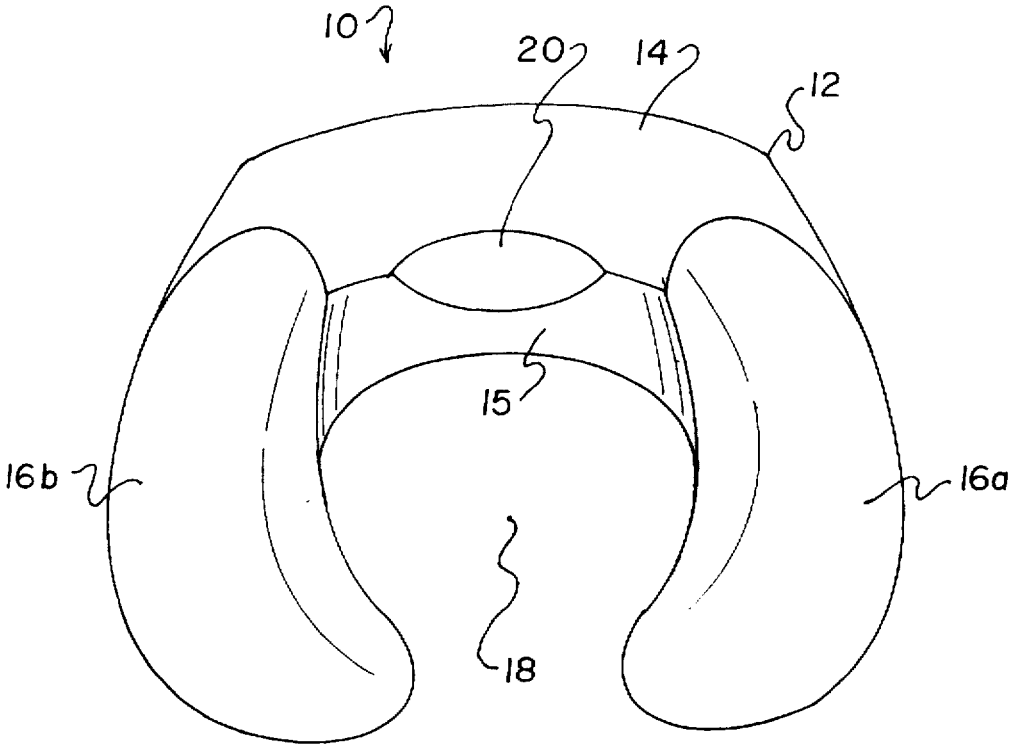
FIG. 1 is a top plan view of a new therapeutic cervical pillow according to the present invention.

With reference now to the drawings, and in particular to FIGS. 1 through 4 thereof, a new therapeutic cervical pillow embodying the principles and concepts of the present invention and generally designated by the reference numeral 10 will be described.

As best illustrated in FIGS. 1 through 4, the therapeutic cervical pillow 10 comprises a concave pillow member 12 having a back portion 14 with an arcuate surface 15, and a pair laterally opposing arcuate side portions 16*a,b* extending forwardly from the back portion 14.

The arcuate side portions 16*a,b* and the back portion arcuate surface 15 define the concavity 18 of the pillow member 12 which is designed for accepting the neck of a person in order to support the cervical spine in a neutral position while sitting.

Preferably, the back portion includes an occipital curved surface 20 which is shaped to support the back or the occipital region of a person's head. The arcuate side portions 16*a,b* are tapered to provide additional comfort to the mandible region of a person's head.

Also preferably, each of the side portions 16*a,b* is pivotable in relation to the back portion in order to better fit the pillow member 12 around a person's neck. Most preferably, each of the side portions 16*a,b* is connected to the back portion 14 by a pivot pin 17*a,b* to permit pivoting of each of the side portions relative to the back portion and the other side portion.

Figure 2:
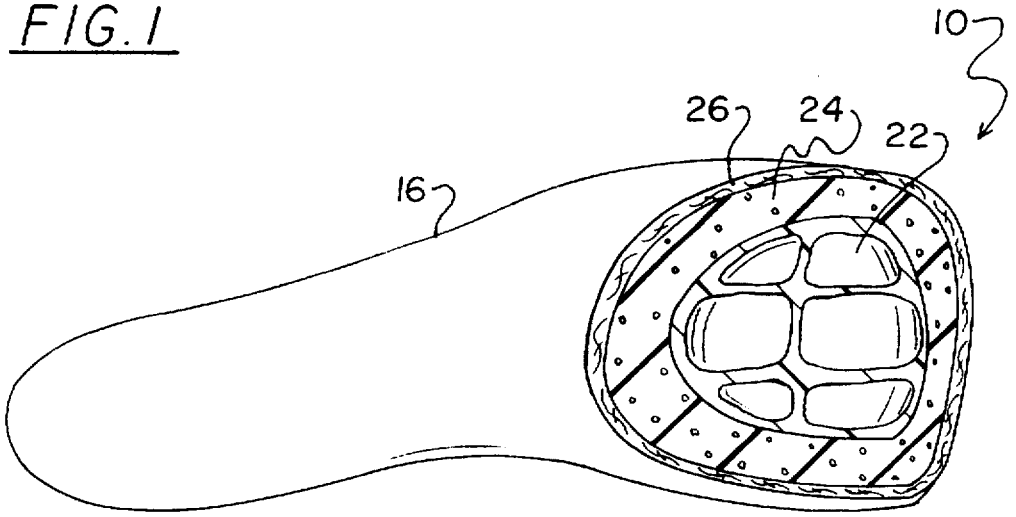
FIG. 2 is a sectional side view showing the construction of the therapeutic cervical pillow.
Figure 3:
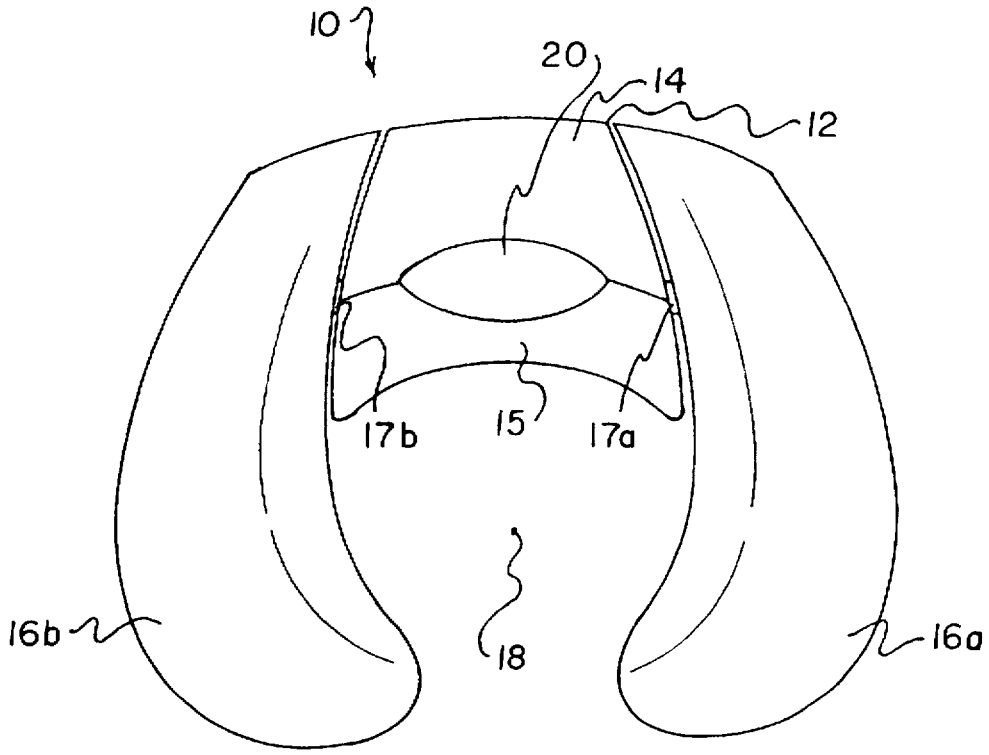
FIG. 3 is a top plan view of the present invention having pivotable arcuate side portions.
Figure 4:
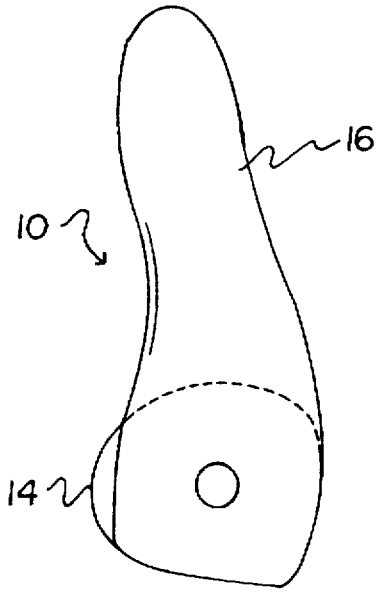
FIG. 4 is a side view of FIG. 3.

As shown in FIG. 2, the concave pillow member is ideally constructed of a stiff material 22 such as plastic surrounded by a foamed material 24 which are both covered by an exterior cloth 26.

In use, the therapeutic cervical pillow 10 is designed for maintaining proper alignment of a person's neck while being seated. The therapeutic cervical pillow 10 is designed to maintain the neck in a neutral position while sitting and helps prevent a person's neck from misalignment when sleeping in a seated position.

Optionally, the therapeutic cervical pillow 10 may be designed so that it may be mounted to the head rest of a vehicular seat to provide comfort while traveling in a vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A therapeutic cervical pillow for maintaining proper alignment of the neck while being seated, comprising:

a concave pillow member having a back portion, and a pair laterally opposing arcuate side portions being extended from said back portion, said back portion having an arcuate surface;

wherein said back portion and said arcuate side portions define a concavity for accepting the neck of a person for supporting the cervical spine, a pivot pin connecting each of said arcuate side portions to said back portion in a manner permitting pivoting into a stationary position of each of said side portions relative to said back portion and the other of said side portions.

2. The therapeutic cervical pillow of claim 1, wherein said back portion includes an occipital curved surface for supporting the back of the head of a person.

3. The therapeutic cervical pillow of claim 1, wherein said back portion and said arcuate side portions are each formed of a stiff interior member surrounded by a pliable covering for adapting to the contours of a user's body.

4. The therapeutic cervical pillow of claim 1, wherein said concave pillow member is constructed of a stiff material covered by a foamed material.

5. The therapeutic cervical pillow of claim 1, wherein said arcuate side portions are tapered to provide additional comfort to the mandible region of a person's head.

6. The therapeutic cervical pillow of claim 1, wherein said concave pillow member is mountable to the head rest of a seat of a vehicle.

7. A therapeutic cervical pillow for maintaining proper alignment of the neck while being seated, comprising:

a concave pillow member having a back portion, and a pair laterally opposing arcuate side portions being extended from said back portion, said back portion having an arcuate surface, said back portion and said arcuate side portions defining a concavity for accepting the neck of a person for supporting the cervical spine; and a pivot pin connecting each of said side portions to said back portion for permitting pivoting of each of said side portions relative to said back portion;

wherein said back portion includes an occipital curved surface for supporting the back of the head of a person;

wherein said concave pillow member is constructed of a stiff material covered by a foamed material; and wherein said arcuate side portions are tapered to provide additional comfort to the mandible region of a person's head.

8. The therapeutic cervical pillow of claim 7 wherein said back portion and said arcuate side portions are each formed of a stiff interior member surrounded by a pliable covering for adapting to the contours of a user's body.

* * * * *